United States Patent [19]

Lavalerie et al.

[11] Patent Number: 4,826,582

[45] Date of Patent: May 2, 1989

[54] SURFACE TREATMENT PROCESS AND DEVICE FOR HEAT EXCHANGERS

[75] Inventors: Claude Lavalerie, Taverny; Jean P. Gaudin, Lyons, both of France

[73] Assignee: Framatome, Courbevoie, France

[21] Appl. No.: 893,438

[22] Filed: Aug. 5, 1986

[30] Foreign Application Priority Data

Aug. 5, 1985 [FR] France ..... 85 11954

[51] Int. Cl.[4] ..... C23F 13/00; C23F 13/02; C25D 17/10

[52] U.S. Cl. ..... 204/196; 204/224 R; 204/224 M; 204/225; 204/272

[58] Field of Search ..... 204/147, 196, 129.35, 204/129.6, 224 R, 224 M, 225, 226, 272, 129.5

[56] References Cited

U.S. PATENT DOCUMENTS 1,982,009 11/1931 McKinney ..... 204/272
2,764,540 9/1956 Farin ..... 204/272
3,857,772 12/1974 Sasaki ..... 204/224 R
4,120,760 10/1978 Ueda ..... 204/147
4,250,011 2/1981 Capello ..... 204/129.6
4,705,611 11/1987 Grimes ..... 204/272

*Primary Examiner*—John F. Niebling
*Assistant Examiner*—Ben C. Hsing
*Attorney, Agent, or Firm*—Pollock, Vande Sande & Priddy

[57] ABSTRACT

A device (50) for treating the inner surface of a steam generator heat exchange tube (1) is introduced into the tube (1), the region to be treated is isolated from the remainder of the tube (1), an electrolyte is circulated in this region to carry out the treatment, an electrical field is created between the treatment device (50) and the tube (1) to produce a migration of ions in both directions, the electrical field created is reduced to zero, the electrolyte is removed to a treatment unit and then a compressed-air purge is carried out, the treated region is rinsed with demineralized water and the water is drained, and, lastly, an additional compressed-air purge is carried out.

7 Claims, 3 Drawing Sheets

SURFACE TREATMENT PROCESS AND DEVICE FOR HEAT EXCHANGERS

FIELD OF THE INVENTION

The invention relates to a surface treatment process and device for the exchanger tubes of the steam generators in pressurized water nuclear reactors.

BACKGROUND OF THE INVENTION

The steam generators of pressurized water nuclear reactors usually contain a bundle of U-shaped tubes the ends of which are fixed in a tube plate. This tube plate divides the steam generator into a region which receives pressurized water, which forms the primary fluid delivering its heat to the steam generator, and a region which receives the feed water to be vaporized in the steam generator. The tube bundle is arranged in the part of the steam generator which receives the water to be vaporized, and the ends of each of the tubes pass through the entire thickness of the plate so that they communicate with the region of the steam generator which receives the pressurized water, or primary fluid. This region forms a water box in two parts, one of which receives the pressurized water and distributes it into the tubes of the bundle, and the other of which collects the pressurized water which has circulated in the tubes, before returning it to the nuclear reactor vessel. The feed water is heated and vaporized by contact with the outer wall of the tubes of the bundle.

The ends of each of the tubes of the bundle are fixed by being swaged in the holes which pass through the entire thickness of the tube plate. This operation, which is also known as expanding, consists in rolling the wall of the ends of the tubes introduced into the tube plate, by means of a tool known as an expander and comprising rolling rollers, which is placed inside the tube over its entire part situated inside the tube plate. The ends of the tube are welded to the tube plate, with their end flush with the face of this tube plate which comes into contact with the primary fluid. The other face of the tube plate is crossed by the tubes which enter the region of the steam generator which receives the water to be vaporized.

The tubes of the bundle form a wall which separates the radioactive primary fluid from the secondary fluid consisting of feed water or its steam. This steam is conveyed towards the turbines associated with the nuclear reactor and situated outside the reactor building which forms the containment enclosure for the reactor. It is very important, therefore, that the tubes provide perfect separation between the primary fluid and the secondary fluid.

When the steam generator enters into operation, this perfect separation of the fluids is ensured, since the integrity of the tube walls and the quality of the welds have been checked. However, after the steam generator has been in use for some time, under very severe operating conditions, this is no longer necessarily the case, because fissures or pinholes may be produced in some of the tubes, especially as a result of corrosion. In fact, steam generators are designed to operate for a very long time and, despite the corrosion resistance of the materials employed in their construction, the tubes, which are generally made of a nickel alloy, can be attacked in some regions.

Two regions have been found to be especially vulnerable to these phenomena, which are both physical and chemical in nature. In fact, in the region of the spacer plates, which consist of a disc containing many drilled holes through which the tubes pass, excitation phenomena due to turbulent flow may make the tubes vibrate in the holes, which results in premature wear of the tube. These drilled holes also give rise to local corrosion effects which may accelerate tube damage. Furthermore, stress corrosion which affects the bottom of the tube can proceed at the surface of the tube plate. In fact, despite destressing during manufacture, a transition region which contains high residual stresses continues to exist in this part.

It is accordingly possible to counteract these faults by taking preventive steps or by repair.

The prevention consists in coating the inner surface of the tubes with a suitable metal which is less susceptible to this type of corrosion. In this case, a deposit may be applied by an electrolytic process without setting up strains; in the case of nuclear power station steam generators the electrolyte may be, in particular, a nickel salt, so as to produce a coating of nickel, a metal which is relatively insensitive to the action of the primary fluid.

The repair is of the internal lining type, fixed by brazing or welding methods. In interventions of this kind, the repair requires three essential stages: location, cleaning and the lining operation itself.

Electropolishing is a process which is highly suitable for cleaning the inner face of the tubes because perfect surface quality and a negligible reduction in thickness can be obtained, so that the original mechanical strength is not altered. Electropolishing is produced by means of an electrolytic process which enables the deposit to be attacked by the action of a potential difference produced between the tool and the tube wall, which makes the oxides dissolve.

FR-A-No. 2,346,819 discloses a process for acidic chemical decontamination of reactor components, especially steam generators or piping, which consists in damming the pipe on both sides of the region to be treated, allowing the active products to act, draining the tube and introducing a corrosion inhibitor and, finally, rinsing with deionized water.

A device is also known from FR-A-No. 2,534,410 for carrying out a decontamination of steam generator tubing by electropolishing, from the lower face of the tube plate and over a low height, at a fixed level.

It is known, however, that the regions requiring intervention are situated at levels which can range over the entire height of the bundle, and it is consequently necessary for intervention to be possible in these regions, but over a low working height.

In fact, electropolishing can be fully controlled only over a region restricted in height, because the current density required varies very rapidly as a function of the surface area. In addition, the quantity of electrolyte is also proportional to the surface area which is treated, while the volume of the effluents containing activated particles must be kept to a minimum.

SUMMARY OF THE INVENTION

The purpose of the invention is therefore to offer a process for electrolytic surface treatment of the inner surface of the steam generator tubes, which limits the required current density and the effluent volume, while remaining applicable at any level in the bundle.

To this end, a device for treating the inner surface of the tube is introduced into the tube, the region to be treated is isolated from the remainder of the tube, an electrolyte is circulated through the said region to carry out the treatment, an electrical field is produced between the treatment device and the tube, to produce ionic migration in both directions, the electrical field produced is reduced to zero, the electrolyte is discharged into a treatment unit and a compressed-air purge is carried out, the treated region is rinsed with demineralized water, the said water is then drained, and, lastly, an additional compressed-air purge is carried out.

Another purpose of the invention is to define an associated device for treating the inner surface of an exchange tube, which device comprises a unit for distributing the various fluids and which is placed outside the tube to be treated, and a treatment unit which is introduced into the tube.

According to the invention, the treatment unit consists of an electrode placed between two expandable seals which are connected to the distribution unit by means including a circuit for supplying an electrolyte or a rinsing fluid to the free space defined between the tube to be treated, the electrode, and the expandable seals, a circuit for discharging the electrolyte or the rinsing fluid and a circuit for supplying a compressed fluid to the expandable seals.

BRIEF DESCRIPTION OF THE DRAWINGS

The invention will be better understood from the following description of a particular embodiment, given by way of example and shown in the attached drawings.

DETAILED DESCRIPTION

Figure 1:
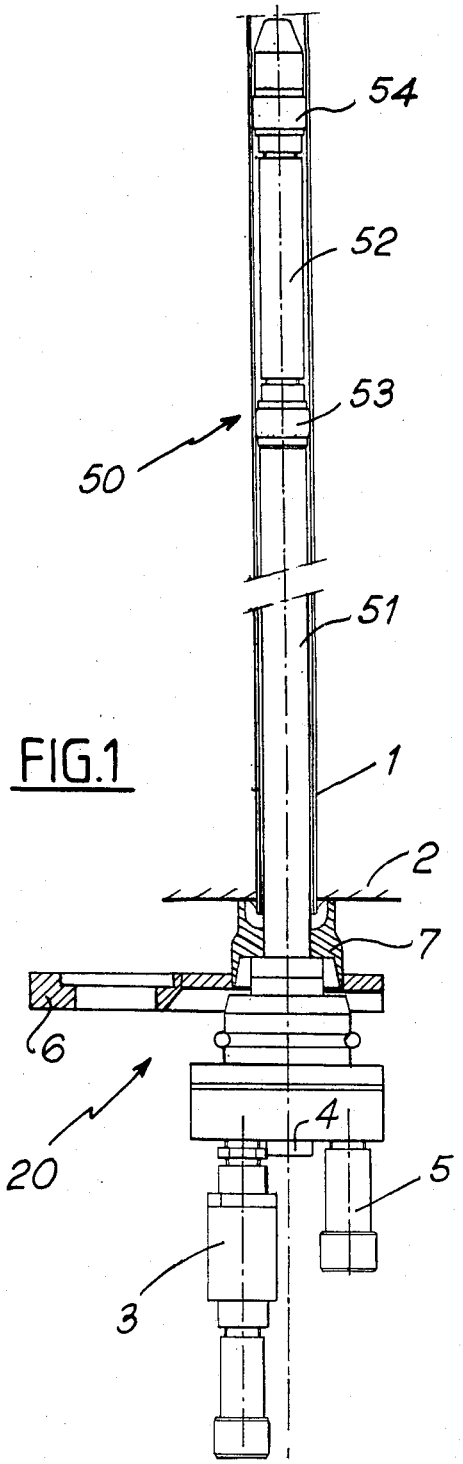
FIG. 1 is a general view of the device according to the invention, inserted in a working position in a steam generator tube.

FIG. 1 shows a steam exchanger tube 1, one end of which is introduced into a hole in a tube plate 2.

The device for treating the inner surface of the tube 1 consists of a lower part 20 which forms a unit for distributing various fluids and is placed under the tube plate 2, and of an upper part introduced into the tube 1 and forming the treatment unit itself.

The lower part 20, which enables the various fluids to be guided into the upper part 50, has connections 3, 4 and 5 for supplying active electrolyte and compressed fluid and for draining the solid-carrying electrolyte, respectively. The lowe part 20 comprises a fixing lug 6 which enables the whole device to be placed on a carrier (not shown), so that the positioning operation can be made automatic.

A spacer 7 is inserted between the lower part 20 and the lower face of the tube plate 2, for use as a height and vertically reference for the device.

The upper part 50 of the device consists of an assembly of coaxial tubes 51 and an electrode 52, placed between two expandable seals 53 and 54. The length of the coaxial tubes 51 is calculated to position the electrode 52 so that the region of the tube 1 which is to be treated lies between the expandable seals 53 and 54.

Figure 2:
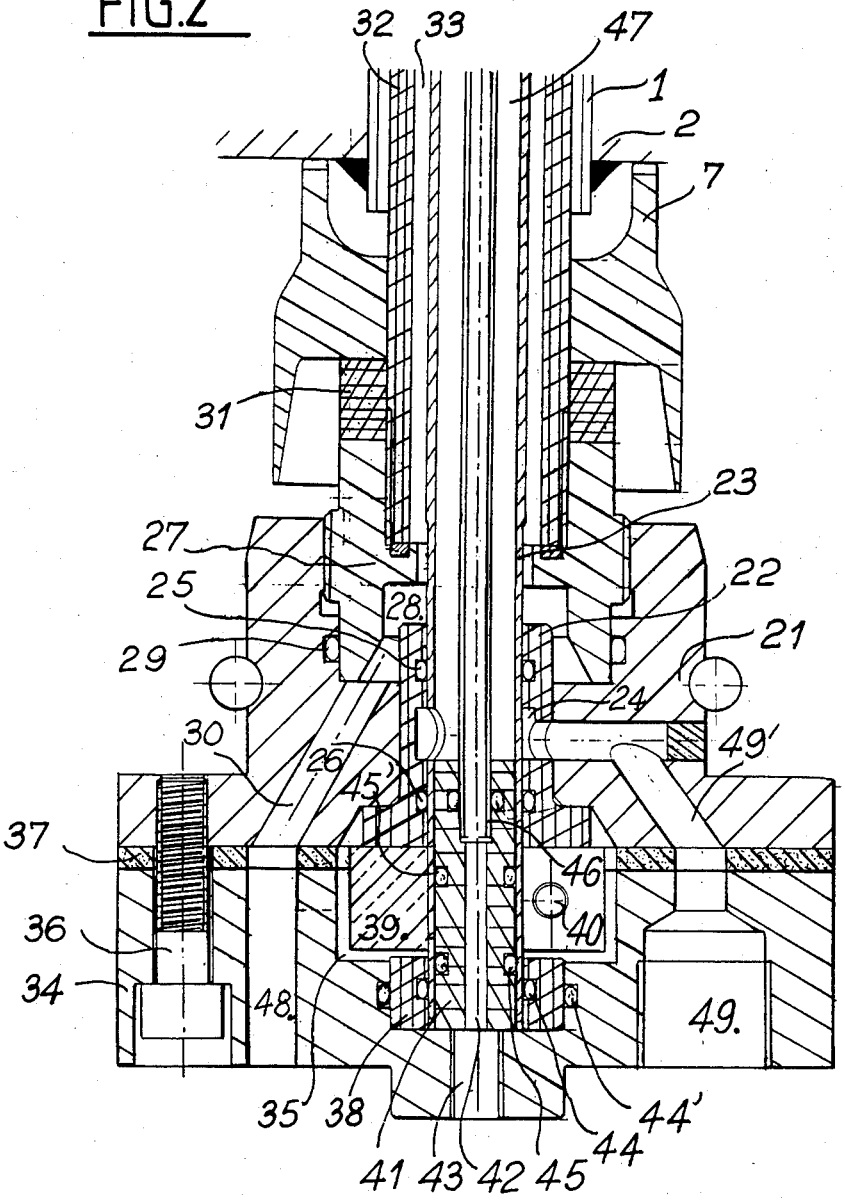
FIG. 2 is a sectional, larger-scale view of the lower part of the device, situated under the tube plate of the steam generator.

The lower part 20 will now be described in greater detail with reference to FIG. 2.

This lower part 20 of the device comprises a metal member 21, inside which is positioned a hollow cylinder 22 made of an insulating plastic. A metal tube 23 is fitted accurately inside the hollow cylinder 22 so that its lower end opens below the metal member 21 and so that its upper end forms one of the coaxial tubes of the unit 51 of the upper part 50 of the device. Together with the metal tube 23, the hollow cylinder 22 forms an inner chamber 24 for controlling electrolyte drainage. Two ring seals 25 and 26 provide sealing between the hollow cylinder 22 and the metal tube 23, isolating the chamber 24 in a leakproof manner.

A hollow cylindrical member 27, equipped with an external thread, is screwed into an overbore in the top part of the metal member 21, forming, together with the latter and the tube 23 which passes through it, an electrolyte supply control chamber 28, which is sealed by the ring seal 25 and by a ring seal 29 which is placed between the metal member 21 and the cylindrical member 27. The chamber 28 is supplied through a channel 30, drilled into the metal member 21.

A washer 31 of the insulating type is inserted between the upper part of the cylindrical member 27 and the spacer 7 so as to absorb impacts when the device is being positioned.

A plastic tube 32 is screwed into the cylindrical member 27 so that its upper end also forms one of the coaxial tubes of the unit 51 which is placed in the tube 1 of the heat exchanger.

The tube 32 has a diameter which is larger than the diameter of the tube 23 and, together with the latter, creates an annular space 33 which communicates with the supply control chamber 28.

A cover 34 which has an internal cavity 35 is fixed by means of a screw 36 to the lower face of the metal member 21, and a seal 37 is inserted between the latter and the said cover 34. The lower end of the metal tube 23 enters the internal cavity 35 in the cover 34 and lodges in an insulating member 38, made of plastic and placed in the said inner cavity 35.

A split annular metal body 39, made, more particularly, of a cast copper alloy, is mounted in the internal cavity 35 around the tube 23 and is locked onto the said tube between the plastic insulating members 22 and 38. Contact between the body 39 and the tube 23 is improved by tightening a screw 40.

A hollow sleeve 41 which has a central bore 42 is introduced into the lower part of the metal tube 23 so that this central bore 42 communicates with the supply connection 4 (FIG. 1) for pressurized fluid, via an orifice 43 drilled along the axis of the cover 34. Sealing between the insulating member 38, the metal tube 23 and the plug 41 is provided by ring seals 44, 44' and 45, 45'.

A small tube 46 is housed in the upper part of the plug 41 so that its upper end also forms one of the coaxial tubes of the unit 51, which are placed in the tube 1 of the heat exchanger. This small tube 46 has a diameter which is smaller than the diameter of the tube 23 and, together with the latter, creates an annular space 47 which communicates with the drainage control chamber 24.

Furthermore, the cover 34 also has an orifice 48 which joins the supply channel 30 for the chamber 28 to the connection 3, and an orifice 49 which joins the chamber 24 to the drainage connection 5 by means of a channel 49' drilled in the metal member 21.

Figure 3:
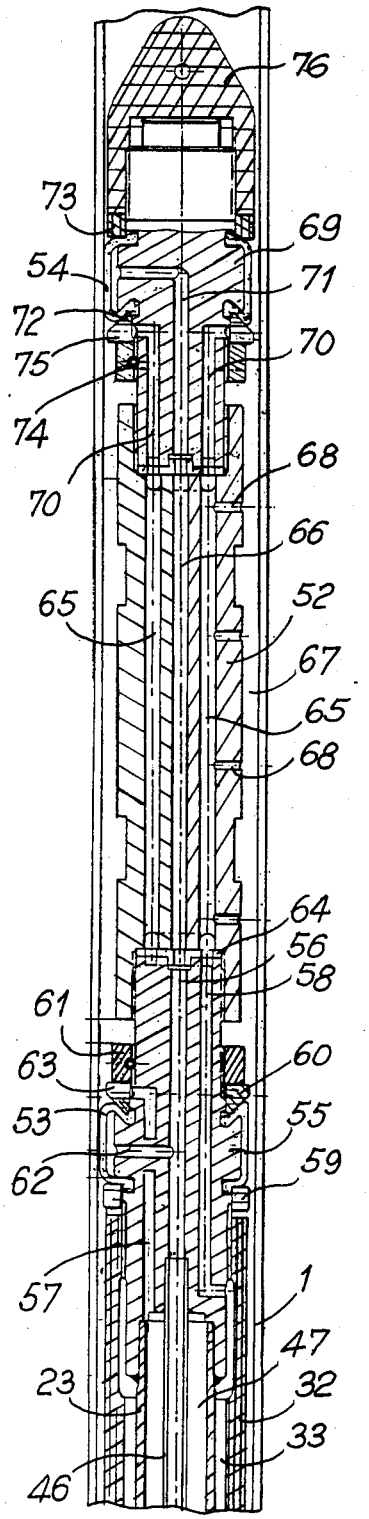
FIG. 3 is a sectional, larger-scale view of the upper part of the device, situated in the tube to be treated.

The upper part 50 of the device will now be described with reference to FIG. 3.

In this figure, the heat exchanger tube 1, and the coaxial tubes 23, 32 and 46, which create the annular spaces 33 and 47 between them can again be seen.

At the end of the plastic tube 32, a thread receives an intermediate cylindrical member 55 drilled with several channels 56, 57 and 58. Channel 56, which is joined to the small tube 46, distributes the pressurized fluid, channel 57 communicates with the annular space 47 for draining the fluid and, lastly, channel 58 is connected to the annular space 33 for supplying electrolyte.

The lower expandable seal 53 is locked between lower ring 59 and an upper ring 60, which are held in place by a self-locking crown ring 61 with a screw. A side branch 62 in the intermediate member 55 distributes the compressed fluid radially towards the lower expandable seal 53. Furthermore, purging orifices 63 which communicate with the channel 57 are machined in the upper ring 60 to remove the supply fluid.

The electrode 52, which consists of a metal body, is screwed onto the upper end of the intermediate member 55 and, with the latter, forms a small chamber 64. This electrode 52 has several channels 65 for supplying electrolyte, which are connected, through the intermediary of the small chamber 64, to the channel 58 in the intermediate member 55 and a central channel 66 for supplying pressurized fluid to the upper expandable seal 54.

The metal body of the electrode 52 has a diameter which is smaller than the internal diameter of the tube 1 so as to create, together with the latter, a sufficient space 67 for circulating the electrolyte. This space 67 communicates with the channels 65 by means fo small radial orifices 68.

A thread at the end of the electrode 52 receives an upper cylindrical member 69 which is also drilled with several channels 70 for supplying an electrolyte and a central channel 71 for supplying pressurized fluid to the expandable seal 54.

The expandable seal 54 is also locked between a lower ring 72 and upper ring 73 rings which are held in place by a self-locking crown ring with a screw.

The overhead supply of active electrolyte is situated immediately under the seal 54 through the ring 72 by means of small radial orifices 75 which communicate with the channels 70 in the upper cylindrical member 69.

To make entry into the exchanger tube 1 easier, especially in the case where positioning is automatic, a nose cone 76 is screwed at the top onto the upper member 69 and comes to bear on the upper ring 73 in parallel.

The treatment of the inner surface of the tube 1 is carried out as follows.

First of all, the region of the exchanger tube 1 which is to be treated is located, and, after this location, the device is introduced into the said tube. The coaxial tube unit 51 of the device is given a length which is suitable for the height of intervention.

The region to be treated is then isolated by pressurizing the expandable seals 53 and 54 by means of the small tube 46 and the channels 56, 66 and 71. The expandable seals 53 and 54 are thus applied against the inner wall of the tube 1.

When sealing has been obtained, the treatment of the inner surface of the tube 1 can begin. This treatment can consist either of cleaning the tube or of a deposition of a metal layer which is compatible with the material of construction of the tube, on the inner surface of the said tube. An acidic electrolyte is used in the case of cleaning and an electrolyte based on a nickel salt in the case of metal deposition.

Accordingly, the chosen electrolyte is injected into the isolated region, passing via the control chamber 28, the annular space 33 and the channels 53, 65 and 70. The electrolyte travels into the space 67 through the small radial orifices 68 and 75 and is discharged in the lower part of the space 67 through the channels 63 and 67, the annular space 47 and the draining orifices 49 and 49', towards a treatment unit.

While the electrolyte circulates, an electrical field is created between the exchanger tube 1 and the electrode 52, by means of the metal members 39 and 22, the tube 23 and the lower member 55. The potential difference thus created causes ion migration in the electrolyte, in order to produce either the deposition of a layer of material by electrolysis, or attack of the corrosive deposit by reverse electrolysis. For an electropolishing operation the dwell time is a few seconds and, more particularly, ten seconds.

Once this operation has been carried out, the electrical field created is reduced to zero.

A multi-branch valve (not shown) may be used in a conventional manner to connect a rinsing circuit to this same loop, to remove all traces of impurities.

Thus, additional purging of the electrolyte using compressed air, rinsing with demineralized water, followed by draining of this water, and, lastly, a compressed air purge, may be carried out.

In addition, an optional intermediate step may be carried out, which consists of the introduction of an inhibitor fluid, followed by draining and by blowing through with compressed air between the electrolyte and rinsing stages.

By virtue of the fixing lug 6, the operation may be made automatic, the device being placed on a remotely controlled carrier.

It can be seen that the chief advantages of the process according to the invention are that it provides, in a very simple manner, cleaning of the inner surface of the tube of extremely efficient protection of the tube against corrosion by the primary fluid, this protection being provided without any modification to the metallurgical and mechanical state of the tube.

Instead, instead of a nickel deposit, a deposit of another metal can be used, provided that this metal is compatible with the material of construction of the tube to be coated.

The process according to the invention can be applied not only to the steam generators of pressurized water nuclear reactors, but also to any steam generator which incorporates tubes whose inner surface come into contact with a fluid which may be corrosive under the operating conditions of the steam generator.

We claim:

1. In an apparatus for the surface treatment of an exchange tube in a steam generator, said apparatus comprising a distribution unit (20) for fluids, placed outside said tube (1) to be treated, and a treatment unit (50) introduced into said tube (1), the improvement wherein said treatment unit (50) comprises (a) an electrode (52) placed between lower and upper expandable seals (53, 54) and joined to said distribution unit (20) by means (51) which have a circuit for supplying electrolyte or a rinsing fluid to a free space (67) defined by said tube (1), said electrode (52) and said expandable seals (53, 54);

(b) a circuit for discharging said electrolyte or rinsing fluid; and (c) a circuit for supplying compressed fluid to said expandable seals (53, 54).

2. The improvement according to claim 1, wherein said means (51) comprise an outer plastic tube (32), a metal tube (23) located within said outer plastic tube and defining with said outer plastic tube (32) a first annular space (33) for said circuit supplying electrolyte or rinsing fluid, and a small plastic tube (46) located inside said metal tube (23) and forming therewith a second annular space (47) for the circuit for discharging electrolyte or the rinsing fluid, said small tube (46) forming said circuit for supplying compressed fluid to said expandable seals (53, 54).

3. The improvement according to claim 2, wherein said outer plastic tube (32), said metal tube (23), and said small plastic tube (46) are coaxial and have a length which is calculated to position said electrode (52) so that a region of said tube (1) to be treated is positioned between said expandable seals (53, 54).

4. The improvement according to claim 2, wherein said electrode (52) is mounted on the end of said coaxial tubes (32, 23, 46) by means of a lower member (55) supporting said lower expandable seal (53) and having an inner channel (57) joined to said second annular space (47), a channel (58) joined to said first annular space (33) and a channel (56) joining said small tube (46) to said lower expandable seal (53) through a branch orifice (62).

5. The improvement according to claim 2, wherein said electrode (52) is connected, by means of said metal tube (23), to an electrical terminal comprising a metal member (39) fixed to a lower part of said metal tube (23) inside said distribution unit (20).

6. The improvement according to claim 2, wherein said distribution unit (20) comprises a connection (3) for supplying electrolyte or rinsing fluid, which is connected to said first annular space (33) by means of a control chamber (28), and channels (30, 48), a connection (4) for supplying compressed fluid and connected to said small tube (46), and a connection (5) for purging solid-carrying electrolyte or rinsing fluid, which is connected to said second annular space (47).

7. The improvement according to claim 1, wherein said electrode (52) comprises several channels (65) connecting said free space (67) via radial orifices (68) to said circuit for supplying electrolyte or rinsing fluid, and comprising a channel (66) for supplying compressed fluid to said upper expandable seal (54) and passing through said seal over its entire length.

* * * * *